United States Patent [19]

Fox

[11] 4,148,328

[45] Apr. 10, 1979

[54] SAFETY SMOKER

[75] Inventor: Alvin F. Fox, South Beach, Oreg.

[73] Assignee: Five Foxes, Inc., Newport, Oreg.

[21] Appl. No.: 763,940

[22] Filed: Jan. 31, 1977

[51] Int. Cl.[2] ..... A24F 13/00; A24F 13/22; A24F 15/00

[52] U.S. Cl. ..... 131/175; 131/180; 131/187; 131/198 R; 131/216

[58] Field of Search ..... 131/186, 187, 170 R, 131/175, 216, 171 R, 171 A, 181, 189, 198; 70/63, 158, 163, 164, 167, 168; 206/242, 248, 265; 221/154, 155, 287

[56] References Cited

U.S. PATENT DOCUMENTS

| | | | |
|---|---|---|---|
| 1,034,717 | 8/1912 | Leeper | 131/181 |
| 1,364,548 | 1/1921 | Fisher | 70/63 |
| 2,779,340 | 1/1957 | Mansfield | 131/175 |
| 3,805,806 | 4/1974 | Grihalva | 131/175 |

*Primary Examiner*—Robert W. Michell
*Assistant Examiner*—V. Millin
*Attorney, Agent, or Firm*—Eugene M. Eckelman

[57] ABSTRACT

A base member has a recess in its top surface, and the bottom wall of the recess has a vertical socket arranged to hold a cigarette upright. A flexible tube is connected into the base member for communication with the socket and has a smoking tip whereby a cigarette in the base member can be smoked by a person remote from the cigarette. A hollow lid is employed which can be locked in place on the base member to prevent access to the cigarette being smoked. The lid has apertures placed at selected upper and lower portions therein to provide a draft ventilation for cigarette smoke.

1 Claim, 3 Drawing Figures

SAFETY SMOKER

BACKGROUND OF THE INVENTION

This invention relates to new and useful improvements in a safety smoking device.

My U.S. Pat. No. 3,955,585 is concerned with a safety smoking device which encloses a cigarette in a locked casing and which has means such that the cigarette is remote from the person smoking it. The structure shown in such patent comprises a casing having an ashtray therein and also having a horizontal cigarette holder which supports a cigarette within the casing in horizontal relation over the ashtray. A lid on the casing is capable of being locked to prevent a person smoking the cigarette from having access thereto. Such a device is desirable for use with persons who are incompetent or incapacitated to the extent that they should not handle a lighted cigarette.

The structure mentioned in said patent has certain disadvantages one of which is that it has an overly complex arrangement of parts as far as molding or other manufacture is concerned, and another disadvantage is that the cigarette is held in a horizontal position, such not being conducive to good burning of the cigarette and also to good ventilation of the smoke.

SUMMARY OF THE INVENTION

According to the present invention and forming a primary objective thereof, a safety smoker is provided that overcomes deficiencies in structure of that shouwn in my U.S. Pat. No. 3,955,585, in that it employs a structure facilitating ready construction by casting, molding, or other methods, and in addition provides good burning of the cigarette and draft ventilation of the smoke.

To carry out the objectives of the invention, a base member is provided having a top recess or ash tray in which a cigarette is arranged to be supported in upright relation. Passageway means project from the cigarette holding portion to an exterior of the base member for attachment to a flexible tube which allows the cigarette to be remotely positioned relative to the person. A tall hollow lid seats on the base member to enclose the cigarette, and such lid has apertures at upper and lower portions thereof to form a draft for burning of the cigarette and for ventilation. A lock is provided between the lid and the base member to prevent access of the smoker to the cigarette.

Additional objects and details of the invention will become apparent from the following description taken in connection with the accompanying drawings.

DETAILED DESCRIPTION OF A PREFERRED EMBODIMENT

Figure 1:
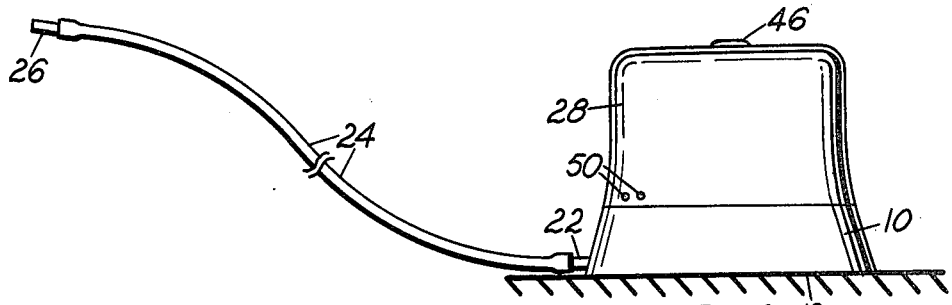
FIG. 1 is a side elevation view of a safety smoker embodying features of the present invention.
Figure 3:
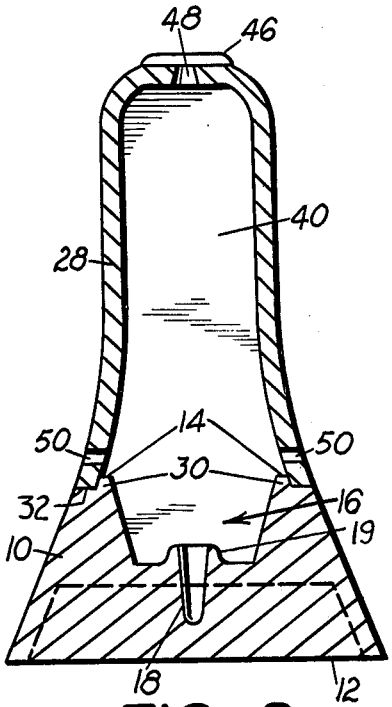
FIG. 3 is a cross sectional view of the smoker without the cigarette, taken on the line 3—3 of FIG. 2.
Figure 2:
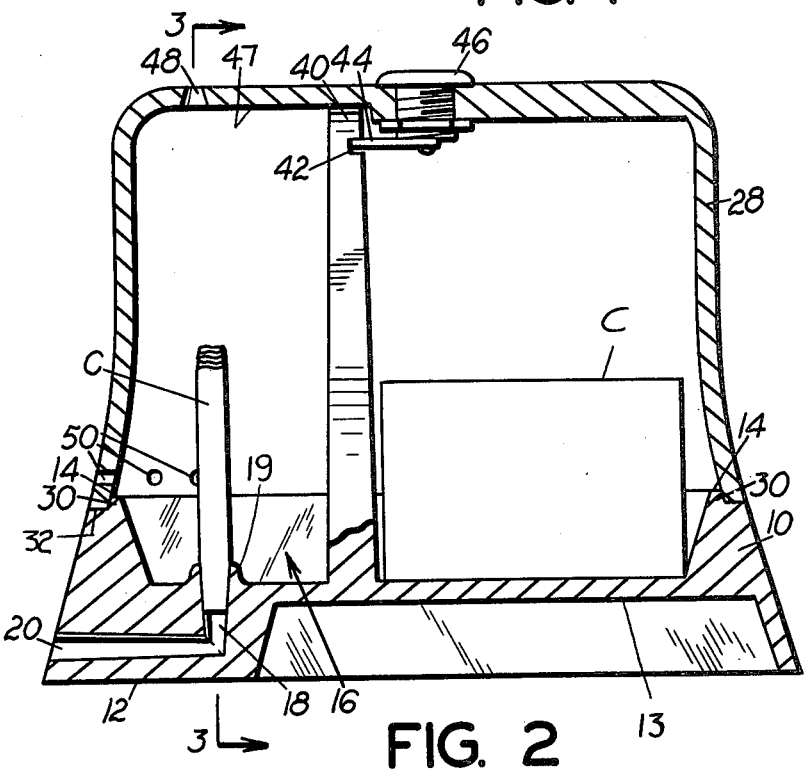
FIG. 2 is an enlarged longitudinal sectional view of the smoker, a cigarette being shown supported in the device.

With particular reference to the drawings, the safety smoker comprises a base member 10 having an enlarged bottom 12 facilitating sturdy support on a table or the like. A portion of bottom 12 is preferably recessed at 13 to reduce weight as well as to reduce manufacturing cost. The top 14 of the base member 10 includes a substantially full length recess 16. Disposed adjacent one end of the recess 16 in the bottom wall thereof is a socket 18 dimensioned to receive the butt end of a cigarette C, FIG. 2, and hold the cigarette in upright relation. This socket is tapered to a larger diameter toward its upper end to readily receive a cigarette and has a boss 19 therearound to prevent ashes from falling into the socket. This socket communicates at its lower end with a passageway 20 opening through the end of the base member. Arranged to fit in the exterior outlet of passageway 20 is a tubular connector 22, FIG. 1, to which a flexible tube 24 is connected. Flexible tube 24 has a smoking tip 26 at its free end, and in a preferred arrangement, the smoking tip 26 and connector 22 are detachable from the tube 24 and from the base member 10 so as to be replaceable as desired. Also in a preferred construction, the passageway 20 is tapered to a larger diameter adjacent its exterior outlet so that the connector 22 will have wedging relation therein. By means of this tapered construction, convenient attachment and detachment of connectors 22 are permitted and in addition different diameters can be used. The tapered socket 18 also has the feature that it can receive different diameter cigarettes and still provide a good but air-tight connection with the cigarettes.

Associated with the base member is a lid 28 having a top wall and enclosing sides. The lid is open at the bottom and is adapted to seat on the top 14 of the base-member 10, the base member 10 having an inset flange 30 around the pocket 16. The bottom edge 32 of lid 26 seats on the top of the base member around the outside of the flange 30.

Projecting upwardly from the base member 10 is a partition 40 having a notch 42 in one of its sides adjacent the top. This notch is engageable by a latch 44 on a key operated lock 46 when the lid is in place whereby to provide a locking position of the lid if desired. Such locked position of the lid can be used to prevent access to the interior of the smoker. Partition 40 also forms a divider in the pocket 16 whereby the remainder of the pocket, namely that area to the right of the partition, can be used as storage for a package of cigarettes. C. Partition 40 is closer to the cigarette holding end than to the other end, and the upper end of this partition projects into a recess 47 in the under surface of the lid top. The recess 47 extends from the end of the lid which is adjacent the partition 40 to a point just past the partition. The recess thus extends less than halfway across the lid whereby the lid must always be installed in the proper end relation. Such arrangement also insures proper locking.

The lid 28 has a vertical dimension at least as higher or greater than the height of a cigarette and includes one or more apertures 48 in its top wall and apertures 50 in the sides and ends adjacent the bottom. The apertures are provided in the area adjacent the cigarette and provide a good chimney-type draft for efficient burning and ventilation of smoke from the cigarette. In fact, the combination of the upright support of the cigarette, together with the draft formed by the upper and lower apertures 48 and 50, respectively, provides for improved efficiency of burning of the cigarette and also provides good removal of the smoke. As stated, the relationship of the recess 47 and the top of partition 40 insures that the lid will be installed with the apertures 48 and 50 at the proper end, namely, at the cigarette end.

The present invention provides a structure that can be readily constructed at a minimum of cost. In addition, its structure provides efficient burning of the cigarette and also efficient ventilation of the smoke.

It is to be understood that the form of my invention herein shown and decribed is to be taken as a preferred example of the same and that various changes in the shape, size and arrangement of parts may be resorted to without departing from the spirit of my invention or the scope of the subjoined claims.

Having thus described my invention, I claim:

1. A safety smoker for permitting a person to smoke a cigarette but to prevent such person if desired from having access to the cigarette, said smoker comprising (a) base means having top and bottom surfaces and surrounding sides, (b) a recess portion in the top surface of said base means having a bottom wall and defining side walls, (c) cigarette holding means in the bottom of said recess arranged to receive the butt end of a cigarette and hold the cigarette in upright relation, (d) a flexible tube having a smoking tip on one end, (e) connecting means in said base means arranged to connect the other end of said flexible tube to said cigarette holding means whereby said cigarette can be smoked from said smoking tip, (f) an upstanding partition on said base means extending higher than the height of a cigarette, (g) an upstanding hollow lid for said base means open at the bottom, (h) said lid being arranged to enclose said partition, said recess, and a cigarette in said cigarette holding means, (i) and key operated lock means in said lid engageable with said partition in locking engagement to lock said lid closed on said base means for preventing access to the cigarette being smoked.

* * * * *